US008430480B2

(12) United States Patent
Yajima et al.

(10) Patent No.: US 8,430,480 B2
(45) Date of Patent: Apr. 30, 2013

(54) LIQUID EJECTION DEVICE

(75) Inventors: Yasushi Yajima, Nagano (JP); Daisuke Hiruma, Nagano (JP); Norihito Harada, Nagano (JP); Ryo Hamano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 13/011,155

(22) Filed: Jan. 21, 2011

(65) Prior Publication Data

US 2011/0199430 A1 Aug. 18, 2011

(30) Foreign Application Priority Data

Feb. 12, 2010 (JP) ..... 2010-028953

(51) Int. Cl.
*B41J 23/00* (2006.01)
*B41J 1/16* (2006.01)
*B41J 25/308* (2006.01)

(52) U.S. Cl.
USPC ..... 347/37; 347/8

(58) Field of Classification Search ..... 347/37, 347/8
See application file for complete search history.

(56) References Cited

U.S. PATENT DOCUMENTS

| | | | | |
|---|---|---|---|---|
| 6,637,958 | B2 * | 10/2003 | Smith | 400/354.3 |
| 6,840,598 | B2 * | 1/2005 | Fairchild et al. | 347/37 |
| 6,964,476 | B2 * | 11/2005 | Okamoto | 347/104 |
| 7,163,277 | B2 * | 1/2007 | Ueda et al. | 347/47 |
| 2009/0122094 | A1 * | 5/2009 | Tsumoto | 347/8 |

FOREIGN PATENT DOCUMENTS

| | | | |
|---|---|---|---|
| JP | 2001-158149 | A | 6/2001 |
| JP | 2003-266850 | A | 9/2003 |
| JP | 2009-269308 | A | 11/2009 |

* cited by examiner

*Primary Examiner* — Matthew Luu
*Assistant Examiner* — Alexander D Shenderov
(74) *Attorney, Agent, or Firm* — Global IP Counselors, LLP

(57) ABSTRACT

The liquid ejection device of the present invention includes a guide shaft; a first guide shaft supporting member and second guide shaft supporting member supporting the guide shaft; a carriage configured to move in reciprocal manner along the guide shaft; and a liquid ejection head mounted to the carriage. The end parts of the first guide shaft supporting member and second guide shaft supporting member on the side of the guide shaft are connected to the guide shaft in the horizontal direction or downward from the horizontal direction orthogonal to the up-down direction with respect to the guide shaft.

5 Claims, 5 Drawing Sheets

LIQUID EJECTION DEVICE

CROSS-REFERENCE TO RELATED APPLICATIONS

This application claims priority to Japanese Patent Application No. 2010-028953 filed on Feb. 12, 2010. The entire disclosure of Japanese Patent Application No. 2010-028953 is hereby incorporated herein by reference.

BACKGROUND

1. Technical Field

The present invention relates to a liquid ejection device such as an inkjet printer, for example.

2. Related Art

A known conventional liquid ejection device is provided with a carriage for mounting a recording head as a liquid ejection head for ejecting ink (liquid) onto a long sheet (recording medium), and a rod-shaped guide shaft for guiding the reciprocal movement of the carriage by sliding against the carriage. In such a liquid ejection device, both end parts of the guide shaft in the movement direction are supported by two plate-shaped frames disposed on both sides of the guide shaft in the movement direction. Oil, grease, or another lubricant is applied to the guide shaft in order to smooth the sliding between the carriage and the guide shaft.

However, as the sheet increases in size, the distance between the two frames in the movement direction increases, and the distance over which the guide shaft is supported by the frames thereby increases. The guide shaft is thereby caused to flex under the weight or movement of the carriage.

In Japanese Laid-Open Patent Publication No. 2003-266850, a middle support member for supporting the center portion of the guide shaft in the movement direction is provided to supplement support of the guide shaft by the frames, in order to suppress flexing of the guide shaft such as described above. The distance in the left-right direction between the sites where the guide shaft is supported is thereby reduced in comparison with a case in which the guide shaft is supported solely by the frames. Flexing of the guide shaft is therefore suppressed.

SUMMARY

In the configuration described above in which a middle support member is provided, since the middle support member is provided in the region in which the liquid ejection head ejects ink to the sheet, lubricant adheres to the sheet when the lubricant of the guide shaft drops onto the sheet below via the middle support member during the period in which the liquid ejection head ejects ink onto the paper sheet.

The present invention was developed in view of the foregoing problems, and an object of the present invention is to provide a liquid ejection device in which flexing of the guide shaft for guiding the movement of the liquid ejection head can be suppressed, and adhesion of the guide shaft lubricant to the recording medium can be suppressed.

In order to achieve the abovementioned objects, a liquid ejection device according to a first aspect includes a frame, a guide shaft, first and second guide shaft supporting members, a carriage, a liquid ejection head and a conveyance mechanism. The guide shaft faces a surface of the frame in a longitudinal direction thereof across a gap. The first guide shaft supporting member and the second guide shaft supporting member support the guide shaft. The first guide shaft supporting member and the second guide shaft supporting member are fixed to the frame. The carriage is configured to move in reciprocal manner along the guide shaft with a lubricant disposed therebetween and applied to the guide shaft. The liquid ejection head is configured to eject liquid toward a recording medium, the liquid ejection head being mounted to the carriage. The conveyance mechanism is configured to convey the recording medium below the guide shaft and the guide shaft supporting members. The end parts of the first guide shaft supporting member and the second guide shaft supporting member on the side of the guide shaft thereof are connected to the guide shaft in a horizontal direction or downward from the horizontal direction orthogonal to an up-down direction with respect to the guide shaft. The first guide shaft supporting member is provided between one end part of the guide shaft in a movement direction of the carriage and one end part of a region in which the liquid ejection head ejects the liquid onto the recording medium. The second guide shaft supporting member is provided between the other end part of the guide shaft in the movement direction of the carriage and the other end part of the region in which the liquid ejection head ejects the liquid to the recording medium.

Through this configuration, the first guide shaft supporting member is provided between one end part of the guide shaft and one end part of the region in which the liquid ejection head ejects liquid to the recording medium, and the second guide shaft supporting member is provided between the other end part of the guide shaft and the other end part of the abovementioned region. Flexing of the guide shaft due to the weight or movement of the carriage can therefore be suppressed relative to a configuration in which the guide shaft supporting members support both end parts in the movement direction of the guide shaft. Moreover, since each of the first guide shaft supporting member and the second guide shaft supporting member is provided outside the abovementioned region, it is possible to suppress adhesion of the guide shaft lubricant to the recording medium via the first guide shaft supporting member and the second guide shaft supporting member.

In the liquid ejection device according to a second aspect, the frame is preferably formed as a square frame body having a facing surface part which has a flat surface facing the surface in the longitudinal direction, on an opposite side from the guide shaft across the gap; and a lateral surface part for connecting the surface in the longitudinal direction and the facing surface part to each other.

Through this configuration, since the frame is formed as a square frame body, the rigidity of the frame is enhanced relative to a configuration in which the frame is composed of a single plate formed only by a flat plate. It is therefore possible to suppress deformation of the frame due to the weight or movement of the carriage. Consequently, it is possible to suppress distortion of the guide shaft due to deformation of the frame.

In the liquid ejection device according to a third aspect, the first guide shaft supporting member and the second guide shaft supporting member are preferably fixed to a flat surface part of the frame and connected at sites opposite the flat surface part in the guide shaft so as to protrude in the horizontal direction from the flat surface part.

Through this configuration, since the first guide shaft supporting member and the second guide shaft supporting member connect the flat surface part of the frame and the sites on the guide shaft which face the flat surface part in the horizontal direction to each other, it is possible to reduce the length of the first guide shaft supporting member and second guide shaft supporting member in the horizontal direction. It is thereby possible to enhance the rigidity of the assembly formed by assembling the frame, the first guide shaft supporting member, the second guide shaft supporting member, and the guide shaft.

In the liquid ejection device according to a fourth aspect, an auxiliary guide shaft for guiding the movement of the carriage and restricting rotation of the carriage is preferably provided higher than the guide shaft of the frame, the auxiliary guide shaft is fixed to the frame via a plurality of auxiliary guide shaft supporting members, and the auxiliary guide shaft supporting members are disposed higher than the auxiliary guide shaft.

Through this configuration, the auxiliary guide shaft supporting members are disposed higher than the auxiliary guide shaft, and the transmission of lubricant to the auxiliary guide shaft supporting members is thereby suppressed even when the lubricant is applied to the auxiliary guide shaft. Consequently, since the auxiliary guide shaft supporting members can also be disposed on the inside in the movement direction of the recording medium, it is possible to enhance the degree of freedom of placement of the auxiliary guide shaft supporting members.

In the liquid ejection device according to a fifth aspect, the auxiliary guide shaft supporting members are preferably fixed to the frame by screw members, through-holes for inserting the screw members in the up-down direction are provided to the auxiliary guide shaft supporting members, and the through-holes are formed in the shape of elongated holes which are elongated in the direction orthogonal to each of the up-down direction and the movement direction of the carriage.

Through this configuration, since the through-holes are formed as elongated holes which are elongated in the facing direction of the frame and the guide shaft, the auxiliary guide shaft supporting members can move in the facing direction. A user can thereby adjust the tilt of the auxiliary guide shaft with respect to the movement direction of the carriage by moving the auxiliary guide shaft supporting members in the facing direction. It is thereby possible to adjust the tilt of the auxiliary guide shaft with respect to the guide shaft. As a result, adjustment can be made so that the guide shaft and the auxiliary guide shaft are parallel to each other even after the guide shaft, first guide shaft supporting member, second guide shaft supporting member, auxiliary guide shaft, and auxiliary guide shaft supporting members have been attached to the frame.

In the liquid ejection device according to a sixth aspect, the frame is preferably attached to a device body in which the conveyance mechanism is accommodated.

Through this configuration, since the frame and the component inside the device body are configured as separate members, after the frame, the guide shaft, the guide shaft support members, the carriage, and the liquid ejection head are assembled, the assembly can be attached to the device body.

BRIEF DESCRIPTION OF THE DRAWINGS

Referring now to the attached drawings which form a part of this original disclosure.

DETAILED DESCRIPTION OF EXEMPLARY EMBODIMENTS

An embodiment in which the present invention is applied to an inkjet printer (hereinafter referred to as the "printer") as a type of liquid ejection device will be described with reference to FIGS. 1 through 6. In the present embodiment, the up-down direction corresponds to the vertical direction, the left-right direction corresponds to the movement direction of the carriage, and the direction orthogonal to each of the up-down direction and the movement direction corresponds to the front-rear direction. The horizontal direction herein includes the left-right direction and the front-rear direction.

Figure 1:
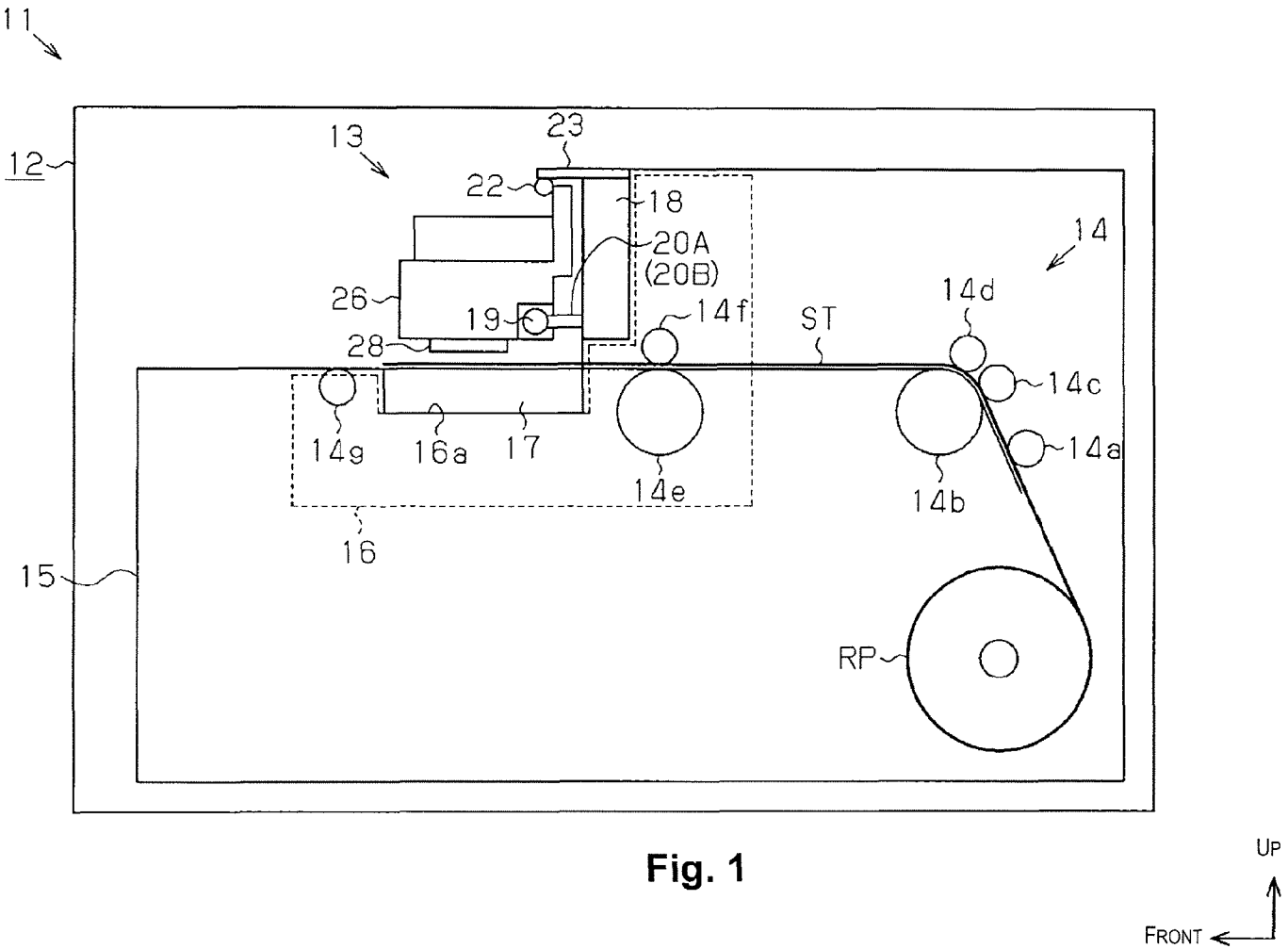
FIG. 1 is a schematic view showing the internal structure of the printer according to an embodiment.

As shown in FIG. 1, the printer 11 retains a continuous paper or other long sheet ST as a recording medium in the state of a paper roll RP in which the sheet ST is wound over itself into a roll, and recording is applied to the sheet ST unwrapped from the paper roll RP.

The printer 11 is provided with a rectangular box-shaped device body 12. A recording unit 13 for recording by ejecting ink onto the sheet ST of the paper roll RP, and a conveyance mechanism 14 for conveying the sheet ST toward the recording unit 13 are accommodated inside the device body 12. The conveyance mechanism 14 is composed of a plurality of rollers 14*a* through 14*g* extending in the left-right direction. The end parts of the rollers 14*a* through 14*g* on both sides thereof are supported by a pair of roller support frames 15 attached to the device body 12 and disposed on both sides of the device body 12 in the left-right direction thereof. A linking frame 16 as a component inside the device body is attached to a part of the roller support frames 15. The linking frame 16 is provided with a top surface 16*a* which is a flat surface for linking the roller support frames 15 in the left-right direction, the top surface 16*a* extending along the front-rear direction and left-right direction. A rectangular plate-shaped platen 17 which is a support stage for supporting the sheet ST is mounted on the top surface 16*a* of the linking frame 16.

Figure 2:
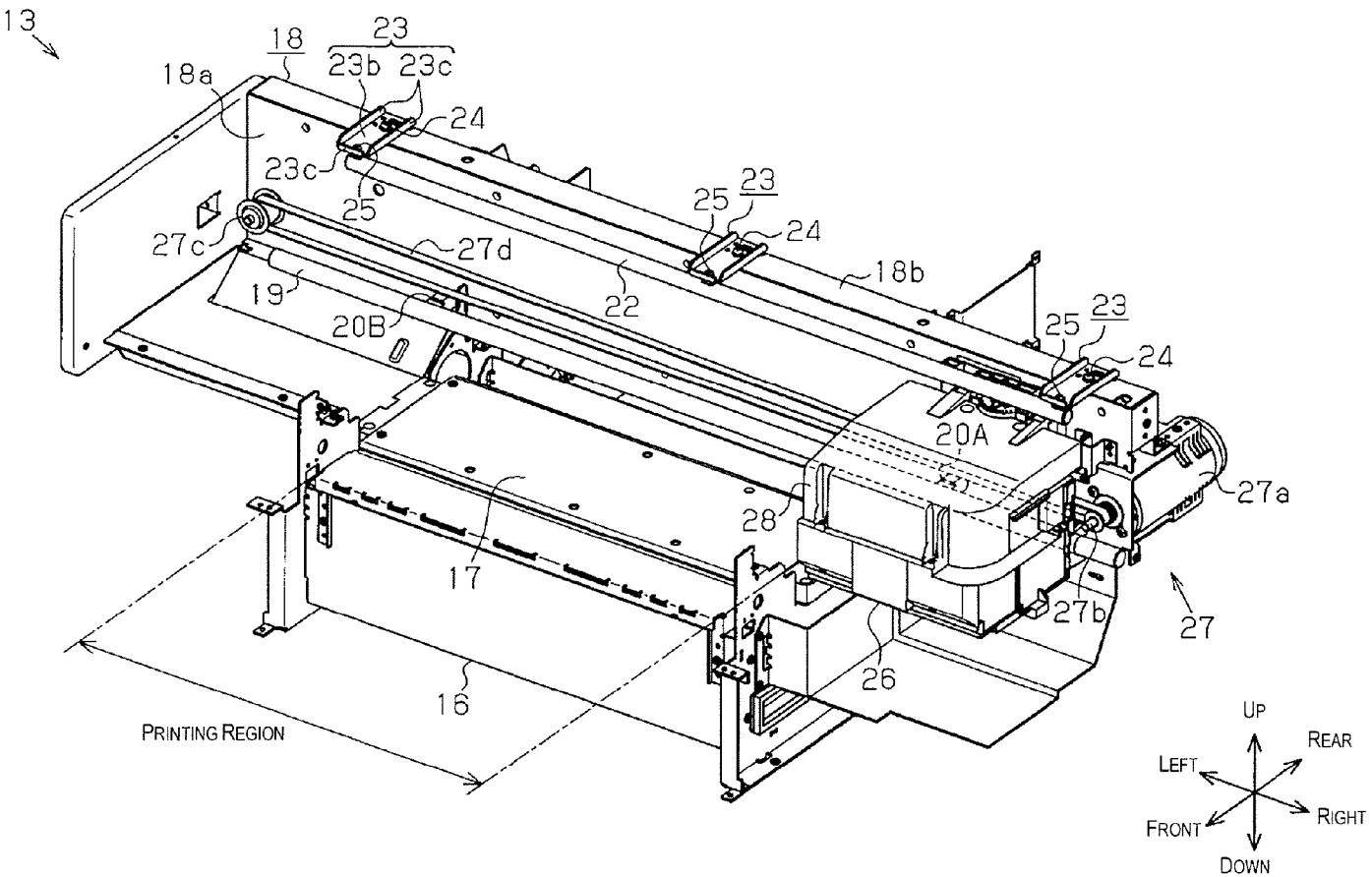
FIG. 2 is a perspective view showing the recording unit in the printer.

As shown in FIG. 2, the recording unit 13 is provided with a frame 18 attached to the linking frame 16 and formed as a square frame body. The front surface of the frame 18 extends in the up-down direction and the left-right direction, and is provided as a flat surface part 18*a* which is an elongated rectangular flat surface elongated more in the left-right direction than the up-down direction.

A guide rail 19 as a guide shaft formed in a round rod shape along the left-right direction so as to face the flat surface part 18*a* in the front-rear direction is disposed in front of the flat surface part 18*a*. The guide rail 19 is attached to a round cylindrical rail supporting member 20A as a first guide shaft supporting member and a round cylindrical rail supporting member 20B as a second guide shaft supporting member which protrude forward with respect to the flat surface part 18*a*. Each of the rail supporting members 20A, 20B is fixed to the flat surface part 18*a* and extend forward from the flat surface part 18*a*. Specifically, the rail supporting member 20A is provided on the right side of the frame 18, and the rail supporting member 20B is provided on the left side of the frame 18. The front end parts of the rail supporting members 20A, 20B, which are the end parts on the guide shaft side of the first guide shaft supporting member and the second guide shaft supporting member, extend forward and are in contact with sites at the rear of the guide rail 19 facing the rail supporting members 20A, 20B in the front-rear direction. The guide rail 19 is fastened to each of the rail supporting members 20A, 20B by screw members 21 (see FIG. 4) inserted into each of the rail supporting members 20A, 20B from the rear surface of the flat surface part 18*a* toward the front, in a state in which the rail supporting members 20A, 20B are in contact with sites on the guide rail 19.

An auxiliary guide rail 22 as an auxiliary guide shaft formed in the shape of a round rod along the left-right direction so as to face the flat surface part 18*a* in the front-rear direction is disposed higher than the guide rail 19. The auxiliary guide rail 22 is attached by screw members 25 to bottom end surfaces 23*a* (see FIG. 4) of three auxiliary rail supporting members 23 as flat plate-shaped auxiliary guide shaft supporting members which protrude forward past the flat surface part 18*a*. In other words, the auxiliary rail supporting members 23 are disposed higher than the auxiliary guide rail 22. Three auxiliary rail supporting members 23 are provided spaced apart from each other in the left-right direction, and the auxiliary rail supporting members 23 are fastened to a top end surface 18*b* of the frame 18 by screw members 24.

A flat plate-shaped base part 23*b* adjacent to the top end surface 18*b* of the frame 18 is provided to each of the auxiliary rail supporting members 23. Each base part 23*b* is provided with a bent part 23*c* formed by folding the front end part and both sides in the left-right direction thereof upward.

The guide rail 19 and the auxiliary guide rail 22 are disposed parallel to each other. The guide rail 19 is also formed so as to have a larger diameter than the auxiliary guide rail 22.

A rectangular carriage 26 is supported by the guide rail 19 and the auxiliary guide rail 22 in a state in which the carriage 26 is able to move reciprocally in the left-right direction along the guide rail 19 and the auxiliary guide rail 22 on the basis of driving by a drive mechanism 27. A recording head 28 as a liquid ejection head for ejecting ink (liquid) toward the sheet ST is mounted at the bottom surface of the carriage 26. Oil, grease, or another lubricant is applied to the guide rail 19 and the auxiliary guide rail 22. Sliding movement of the carriage 26 in relation to the guide rail 19 and the auxiliary guide rail 22 is thereby facilitated.

The drive mechanism 27 is composed of a drive motor 27*a* attached at the right end of the frame 18, a drive-side pulley 27*b* attached to an output shaft of the motor 27*a*, a driven-side pulley 27*c* provided at the left end of the frame 18, and a circular belt 27*d* for linking the pulleys 27*b*, 27*c*. A portion of the belt 27*d* is attached to the carriage 26. The drive mechanism 27 is configured so that the rotational force of the drive motor 27*a* is transmitted to the belt 27*d* via the drive-side pulley 27*b*, and the carriage 26 is thereby moved in the left-right direction.

A fixed range from the left end of the platen 17 to the right end thereof is designated as the printing range in the recording unit 13. Ink is ejected from the recording head 28, which moves in reciprocal manner together with the carriage 26 with respect to the sheet ST in a stopped state on the platen 17, and printing is thereby applied to the sheet ST (see FIG. 1).

One of the auxiliary rail supporting members 23 is disposed at the center position in the left-right direction of the printing region, and the other two auxiliary rail supporting members 23 are disposed at equal intervals from the center-position auxiliary rail supporting member 23 in the left-right direction. The distance between adjacent auxiliary rail supporting members 23 in the left-right direction is less than the distance between the rail supporting members 20A, 20B in the left-right direction.

Figure 3:
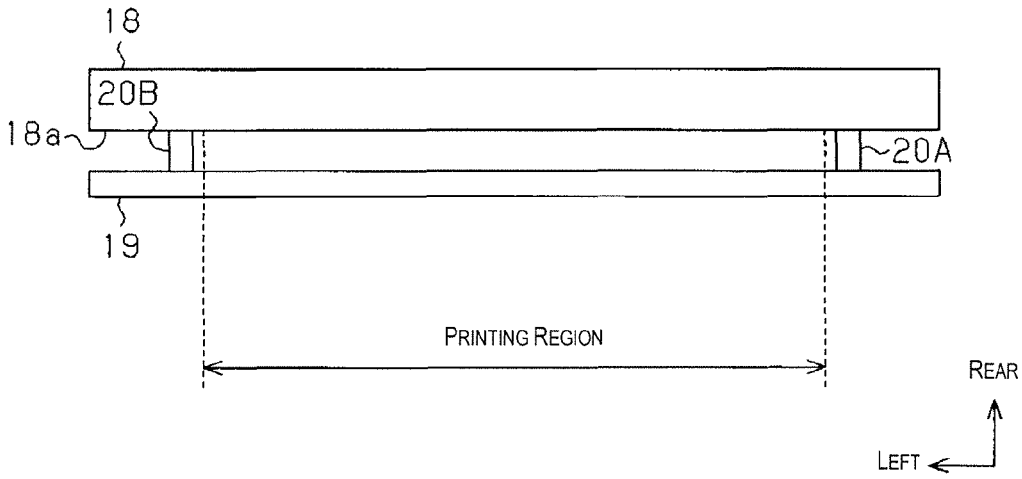
FIG. 3 is a top view showing the positional relationship of the frame, the guide rail, and the rail support members.

As shown in FIG. 3, the rail supporting member 20A is disposed to the right of the printing region and adjacent to the printing region in the left-right direction, and to the left of the right end part of the guide rail 19. The rail supporting member 20B is disposed to the left of the printing region and adjacent to the printing region in the left-right direction, and to the right of the left end part of the guide rail 19. In other words, the guide rail 19 extends further to the right than the rail supporting member 20A and further to the left than the rail supporting member 20B. The length of the guide rail 19 from the rail supporting member 20A to the right end surface of the guide rail 19, and the length of the guide rail 19 from the rail supporting member 20B to the left end surface of the guide rail 19 are equal to each other.

The support structure for the carriage 26, formed by the guide rail 19 and the auxiliary guide rail 22, will next be described in detail with reference to FIG. 4.

Figure 4:
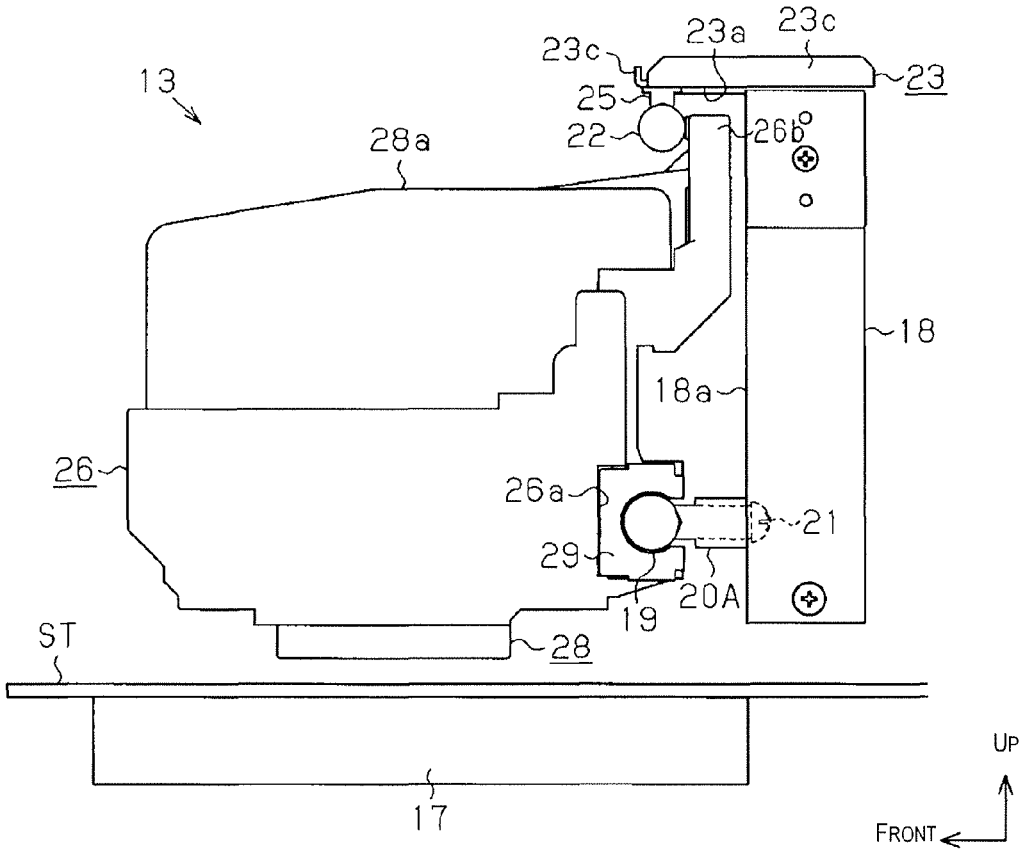
FIG. 4 is a side view showing the recording unit in the printer.

As shown in FIG. 4, a concave part 26*a* indented forward from the rear surface of the carriage 26 and opening toward the rear is provided at both end parts in the left-right direction at sites at the bottom rear of the carriage 26. Bearing members 29 for slidably receiving the guide rail 19 by fitting with the guide rail 19 are attached to the concave parts 26*a*. The bearing members 29 are rectangular flat plate-shaped oil-retaining bearings having an arc-shaped internal peripheral surface open toward the rear. Such a configuration enables the carriage 26 to move in reciprocal manner in the left-right direction on the guide rail 19 and rotate about the guide rail 19. The bearing members 29 are also provided with felt (not shown) for supplying oil to the bearing members 29.

A protruding part 26*b* which protrudes upward past a top end part 28*a* of the recording head 28 is provided at the top rear of the carriage 26. The front surface of the protruding part 26*b* is in sliding contact with the auxiliary guide rail 22. Consequently, the carriage 26 is enabled to move in reciprocal manner in the left-right direction by the auxiliary guide rail 22, and the position of the carriage 26 in the rotation direction thereof about the guide rail 19 is restricted.

The structure of the frame 18 will next be described in detail with reference to FIG. 5.

Figure 5A:
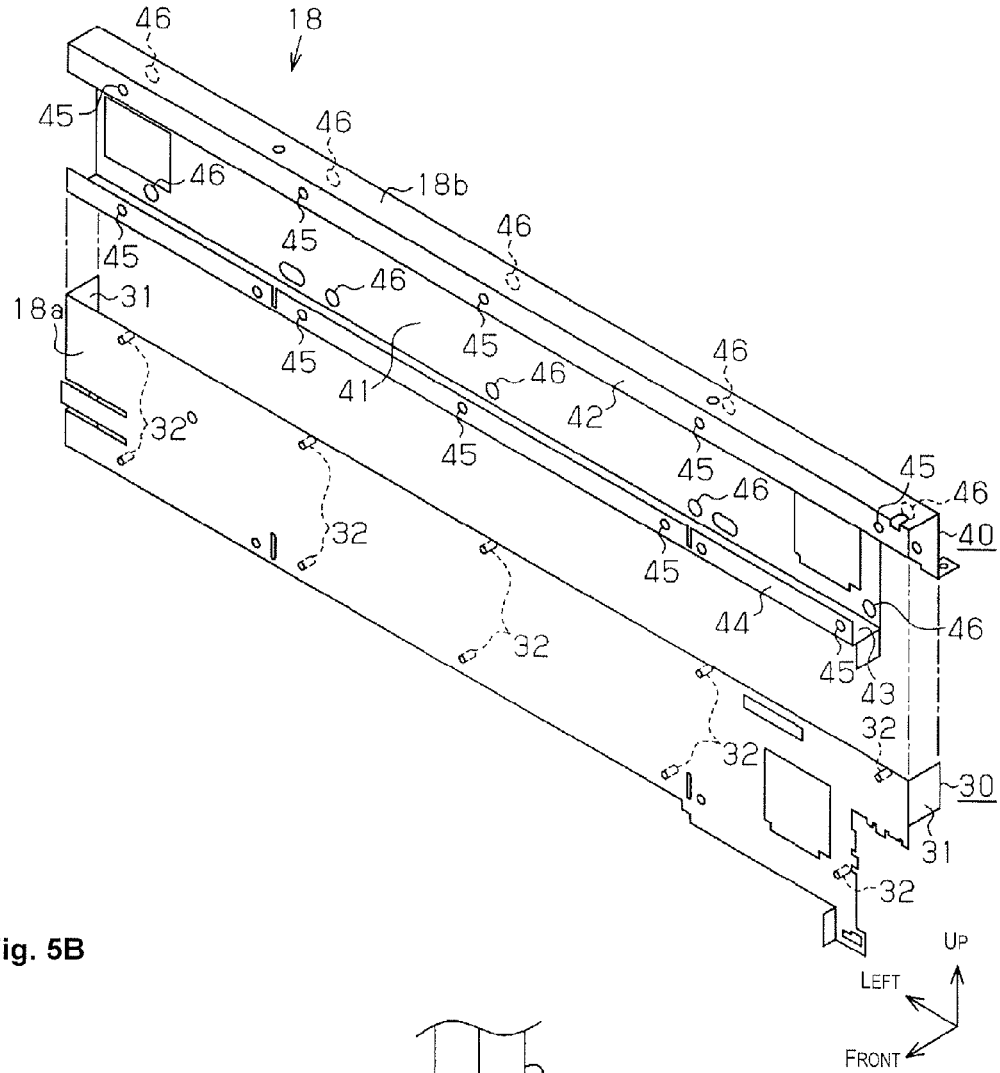
FIG. 5A is an exploded perspective view showing the frame in the recording unit.

As shown in FIG. 5A, the frame 18 is formed by combining a first frame 30 and a second frame 40 which are each molded by pressing metal plates.

First lateral surface parts 31 are formed in the first frame 30, the first lateral surface parts 31 having a front surface formed as the flat surface part 18*a*, and bending and extending to the rear from portions of the flat surface part 18*a* on both sides thereof in the left-right direction.

A facing surface part 41 parallel to the flat surface part 18*a* and facing the flat surface part 18*a* in the front-rear direction is formed in the second frame 40. The top end surface 18*b* is provided at the top end part of the facing surface part 41. An upper contacting part 42 extending downward and having a contacting surface in contact with the rear surface of the flat surface part 18*a* is provided at the front end of the top end surface 18*b*. A lower lateral surface part 43 parallel to the top end surface 18*b* and having a lateral surface extending toward the front is provided at the bottom end part of the facing surface part 41. A lower contacting part 44 extending upward and having a contacting surface in contact with the rear surface of the flat surface part 18*a* is provided at the front end of the lower lateral surface part 43.

Five burring parts 32 spaced apart in the left-right direction are provided at locations of the first frame 30 which correspond to the upper contacting part 42 and the lower contacting part 44. The burring parts 32 are formed in cylindrical shapes extending to the rear by applying burring to the flat surface part 18*a*. Fitting holes 45 for fitting with the burring parts 32 are provided in each of the locations of the second frame 40 which correspond to the burring parts 32 in the upper contacting part 42 and the lower contacting part 44.

Figure 5B:
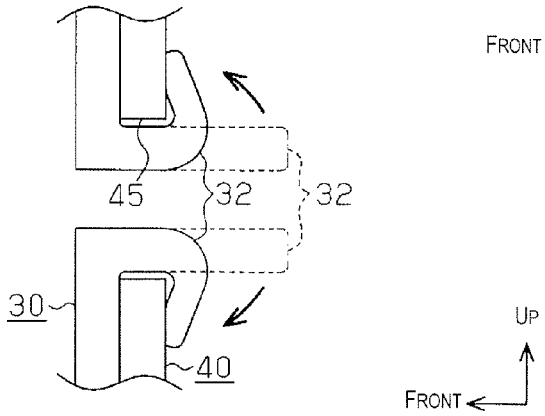
FIG. 5B is an enlarged view showing the flange staking.

As shown in FIG. 5B, in a state in which the fitting holes 45 are fitted in the burring parts 32, the first frame 30 and the second frame 40 are fastened to each other by applying a flange staking whereby the burring parts 32 are plastically deformed toward the front.

Through-holes 46 which pass through the facing surface part 41 in the front-rear direction are provided at the locations of the facing surface part 41 which correspond to the fitting holes 45 (see FIG. 5A). Staking fixtures can thereby be inserted into the through-holes 46 and the burring parts 32 plastically deformed when flange staking is performed by a press machine.

Figure 6:
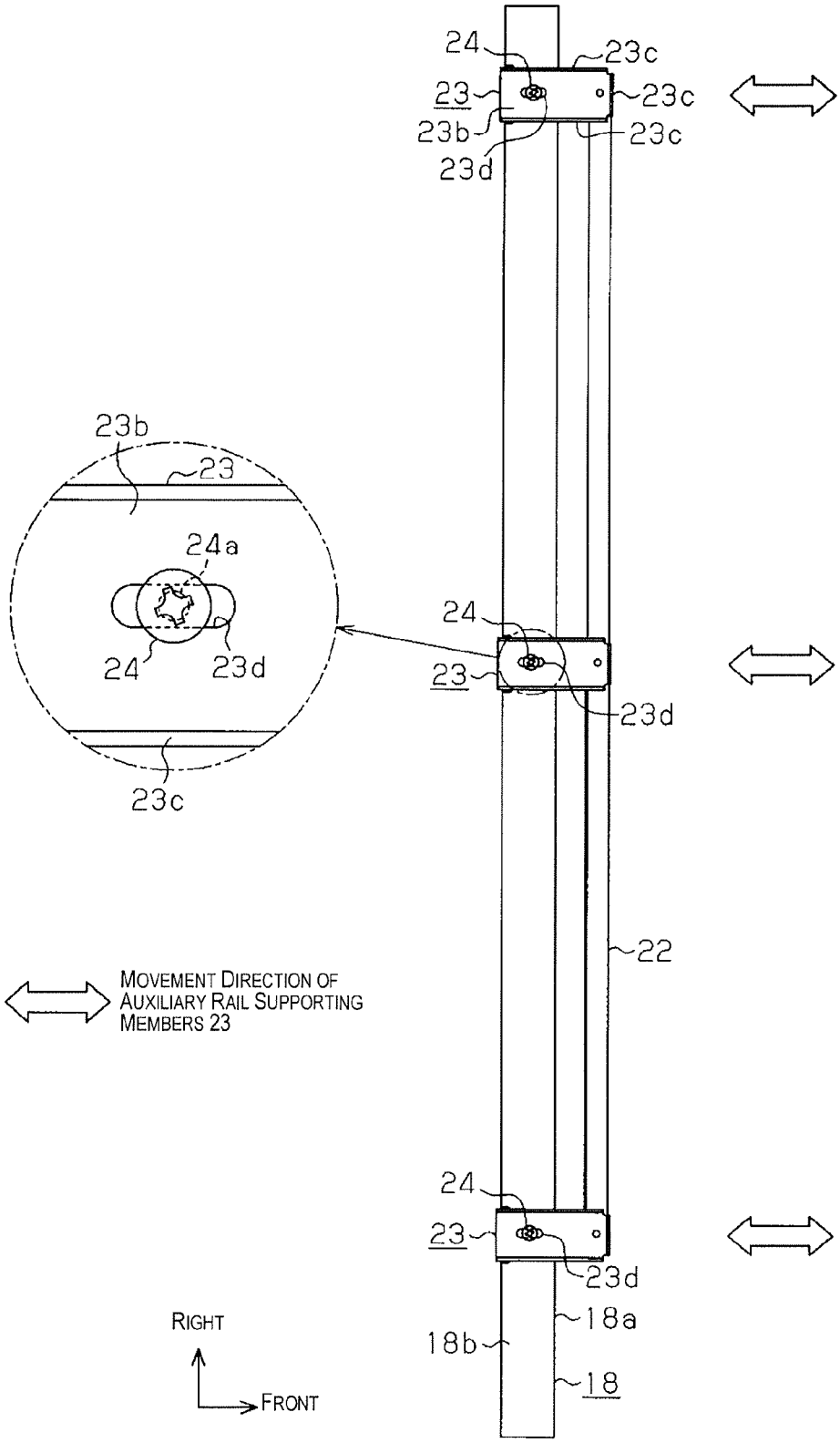
FIG. 6 is a top view showing a state in which the frame and the guide rail are assembled in the recording unit.

The position adjustment structure and position adjustment method for the auxiliary rail supporting members 23 will next be described with reference to FIG. 6. FIG. 6 does not show the screw members 24.

As shown in FIG. 6, an elongated hole 23*d* having the front-rear direction as the major axis thereof is provided to each of the auxiliary rail supporting members 23. The auxiliary rail supporting members 23 are fastened by screw members 24 to the top end surface 18*b* of the frame 18 via the elongated holes 23*d*, and are thereby fixed to the frame 18. In the front-rear direction in which the frame 18 and the guide rail 19 face each other, the length of the elongated holes 23*d* is greater than the outside diameter of the shaft parts 24*a* (dashed-line circles in FIG. 5) of the screw members 24.

A user may loosen the fastening of the screw members 24, thereby enabling the auxiliary rail supporting members 23 such as described above to be moved in the front-rear direction within the range of the elongated holes 23*d* even after being fastened to the frame 18 by the screw members 24.

In such a case as when the auxiliary guide rail 22 is tilted in the left-right direction with respect to the guide rail 19, the user adjusts the tilt of the auxiliary guide rail 22 with respect to the left-right direction so that the auxiliary guide rail 22 is parallel to the guide rail 19 by loosening the screw members 24 and moving the auxiliary rail supporting members 23 in the front-rear direction.

Such effects as the following can be obtained by the embodiment described above.

(1) The carriage 26 slidably moves in reciprocal manner on the guide rail 19, and the lubricant of the guide rail 19 thereby sometimes adheres to the flat surface part 18*a* via the rail supporting members 20A, 20B. The lubricant adhering to the flat surface part 18*a* then drops downward from the lower end part of the flat surface part 18*a* under its own weight. In cases in which the sheet ST is being conveyed below the frame 18 at this time, there is a risk of the lubricant adhering to the sheet ST.

Moreover, since the bearing members 29 are provided to the carriage 26, oil exuded from the bearing members 29 is also transmitted along the rail supporting members 20A, 20B via the guide rail 19. The oil of the rail supporting members 20A, 20B then drops downward from the flat surface part 18*a* in the same manner as the lubricant, thereby creating a risk of oil adhering to the sheet ST.

In the present embodiment, however, since the rail supporting member 20A is disposed to the right of the printing region, and the rail supporting member 20B is disposed to the left of the printing region, even when lubricant and oil are transmitted to the rail supporting members 20A, 20B from the guide rail 19, the lubricant and oil are prevented from adhering to the sheet ST.

The rail supporting member 20A is also provided to the left of the right end part of the guide rail 19, and the rail supporting member 20B is provided to the right of the left end part of the guide rail 19. Consequently, the distance between the rail supporting members 20A, 20B in the left-right direction is reduced in comparison with a configuration in which the rail supporting members support both end parts of the guide rail in the left-right direction, and it is therefore possible to suppress flexing of the guide rail 19 due to the weight or movement of the carriage 26.

Moreover, since the guide rail 19 extends further to the right than the rail supporting member 20A and further to the left than the rail supporting member 20B, a second moment occurring at a site outside the rail supporting members 20A, 20B of the guide rail 19 in the left-right direction occurs with respect to a first moment which occurs about each of the rail supporting members 20A, 20B due to the weight of the carriage 26 and the recording head 28. The first moment and the second moment occur in opposite directions and therefore cancel each other out. As a result, flexing of the guide rail 19 due to the first moment can be suppressed.

(2) In a configuration in which the frame is composed of a single plate formed only by a flat plate, distortion of the flat surface part of the frame can be caused by deformation of the frame when the carriage 26 and the recording head 28 are attached to the guide rail 19. The rail supporting members 20A, 20B fixed to the flat surface part thereby sometimes tilt from the pre-set positions thereof. This tilting is sometimes accompanied by tilting of the guide rail 19, which is fixed to each of the rail supporting members 20A, 20B, from the pre-set position thereof. As a result, the carriage 26 and the recording head 28 are tilted, and the carriage 26 and the recording head 28 move in a direction that is tilted with respect to the left-right direction.

In the present embodiment, however, since the frame 18 is formed as a square frame body, the rigidity of the frame 18 is enhanced in comparison with a configuration in which the frame is composed of a single plate formed only by a flat plate. It is thereby possible to suppress deformation of the frame 18 due to the weight and movement of the carriage 26. Distortion of the guide rail 19 due to deformation of the frame 18 can thereby be suppressed. Consequently, it is possible to suppress tilting of the carriage 26 and recording head 28, and movement thereof in a direction that is tilted with respect to the left-right direction.

(3) Since the rail supporting members 20A, 20B connect the flat surface part 18*a* of the frame 18 with sites of the guide rail 19 opposite the flat surface part 18*a* in the front-rear direction, the length of the rail supporting members 20A, 20B in the front-rear direction can be reduced. The rigidity of the assembly formed by assembling the frame 18, the rail supporting members 20A, 20B, and the guide rail 19 can thereby be enhanced.

(4) The center auxiliary rail supporting member 23 in the left-right direction is disposed in the printing region. However, since the auxiliary rail supporting members 23 are disposed higher than the auxiliary guide rail 22, the lubricant of the auxiliary guide rail 22 is prevented from being transmitted to the auxiliary rail supporting members 23. Since the auxiliary rail supporting members 23 can therefore also be disposed in the printing region of the sheet ST, the degree of freedom of placement of the auxiliary rail supporting members 23 can be enhanced.

(5) Since the length of the elongated hole 23*d* of the auxiliary rail supporting members 23 in the front-rear direction is greater than the outside diameter of the shaft parts 24*a* of the screw members 24, the auxiliary rail supporting members 23 are able to move in the front-rear direction. A user can thereby adjust the tilt of the auxiliary guide rail 22 with respect to the front-rear direction by moving the auxiliary rail supporting members 23 in the front-rear direction. The tilt of the auxiliary guide rail 22 with respect to the guide rail 19 in the front-rear direction can thereby be adjusted. Consequently, adjustment can be made so that the guide rail 19 and the auxiliary guide rail 22 are parallel to each other in the front-rear direction even after the guide rail 19, the rail supporting members 20A, 20B, the auxiliary guide rail 22, and the auxiliary rail supporting members 23 have been attached to the frame 18.

(6) Since the frame 18 and the linking frame 16 are configured as separate members, after the guide rail 19, the rail supporting members 20A, 20B, the auxiliary guide rail 22, the auxiliary rail supporting members 23, the carriage 26, and the recording head 28 are assembled to the frame 18, the assembly can be attached to the linking frame 16.

(7) Since the frame 18 is formed by combining the first frame 30 and the second frame 40, which are molded by pressing, manufacturing cost can be reduced in comparison with a configuration in which the frame is formed by aluminum die casting or other casting.

(8) Since the frame 18 is assembled by flange staking the first frame 30 and the second frame 40, the number of components can be reduced in comparison with a configuration in which the first frame and the second frame are assembled using screw members or other fastening members. The number of steps required to manufacture the frame 18 can also be reduced in comparison with a case of assembly using fastening members.

(9) The frame 18 is formed so as to be longer in the left-right direction than in the up-down direction, and the top end surface 18*b* and lower lateral surface part 43 thereof are formed so as to extend in the left-right direction. The rigidity of the frame 18 is therefore enhanced in comparison with a configuration in which the frame is formed so that the top end surface and lower lateral surface part thereof extend in the up-down direction. It is therefore possible to reduce the amount of deformation of the frame 18 due to the weight or movement of the carriage 26.

(10) Since the bent part 23*c* is provided to the auxiliary rail supporting members 23, the rigidity of the auxiliary rail supporting members 23 is enhanced. It is thereby possible to suppress deformation of the auxiliary rail supporting members 23 in response to the force applied to the auxiliary rail supporting members 23 from the auxiliary guide rail 22 by contact of the carriage 26 with the auxiliary guide rail 22.

(11) Since flange staking is applied to the frame 18 from the rear, a jig for receiving the force over the entire area of the front surface of the flat surface part 18*a* can be placed during flange staking. Consequently, reductions in flatness caused by flange staking of the flat surface part 18*a* can be suppressed in comparison with a configuration in which a jig is provided to receive force for each burring part. Tilting of the guide rail 19 with respect to the left-right direction can thereby be suppressed.

(12) Since the diameter of the auxiliary guide rail 22 is smaller than the diameter of the guide rail 19, the auxiliary guide rail 22 is more easily flexed than the guide rail 19. In the present embodiment, however, providing three auxiliary rail supporting members 23 enables flexing of the auxiliary guide rail 22 to be suppressed. The same effects can also be demonstrated when four or more auxiliary rail supporting members 23 are provided.

(13) The diameter of the auxiliary guide rail 22 is smaller than the diameter of the guide rail 19, and the distance in the left-right direction between adjacent auxiliary rail supporting members 23 is smaller than the distance between the rail supporting members 20A, 20B in the left-right direction. The guide rail 19 and the auxiliary guide rail 22 thereby each have different characteristic frequencies. Vibration of the guide rail 19 caused by the reciprocal movement of the carriage 26 is prevented from creating resonance with the auxiliary guide rail 22. Since an increase in the vibration of the carriage 26 is thereby suppressed, the vibration is prevented from affecting the landing position of ink ejected from the recording head 28 onto the sheet ST.

The embodiment described above may be modified as described below.

In the embodiment described above, the frame 18 may be fixed to a component (e.g., the roller support frames 15) in the device body 12 other than the linking frame 16.

In the embodiment described above, the frame 18 and the linking frame 16 may be configured as the same member. In other words, the flat surface part 18*a* may be formed so as to extend in the left-right direction continuously from the linking frame 16.

In the embodiment described above, the structure of adjusting the position of the auxiliary rail supporting members 23 may be omitted. In other words, circular holes having substantially the same inside diameter as the shaft parts 24*a* of the screw members 24 may be formed instead of the elongated holes 23*d* of the auxiliary rail supporting members 23 into which the screw members 24 are inserted.

In the embodiment described above, the auxiliary rail supporting members 23 may be fixed to the flat surface part 18*a* of the frame 18. In this case, a contacting part which makes contact with the flat surface part 18*a* is provided to the auxiliary rail supporting members 23, and the contacting part is fixed to the flat surface part 18*a* by screw members 24.

In the embodiment described above, the number of auxiliary rail supporting members 23 may be other than three. Rail supporting members may also be provided in addition to the rail supporting members 20A, 20B insofar as the additional rail supporting members are outside the printing region in the left-right direction and further toward the inside than both ends of the guide rail 19 in the left-right direction.

In the embodiment described above, the auxiliary guide rail 22 may have a square cross-sectional shape or any other cross-sectional shape insofar as the auxiliary guide rail 22 is able to slide against the carriage 26 and restrict the rotation direction of the carriage 26. The auxiliary guide rail 22 may also be substantially L-shaped and be composed of a first part which bends from the top of the flat surface part 18*a* of the frame 18 and extends forward, and a second part which extends from the bottom of the front end of the first part. The auxiliary rail supporting members 23 may be omitted in a case in which the auxiliary guide rail 22 and the first frame 30 are configured as a single member.

In the embodiment described above, the auxiliary guide rail 22 may be omitted.

In the embodiment described above, each of the rail supporting members 20A, 20B may be fixed to the bottom end surface of the frame 18. The bottom end part of the guide rail 19 may also be in contact with the top end parts of each of the rail supporting members 20A, 20B. In this case, each of the rail supporting members 20A, 20B is formed as flat plate shapes extending in the front-rear direction and the left-right direction. The bearing members 29 of the carriage 26 are configured so as to slide only against parts of the guide rail 19 above the rail supporting members 20A, 20B, by opening higher than the rail supporting members 20A, 20B of the guide rail 19.

In the embodiment described above, the frame 18 may be formed only from the first frame 30 or the second frame 40. In this case, the frame 18 is formed as a square frame body by pressing and folding the first frame 30 or the second frame 40.

In the embodiment described above, the rail supporting members 20A, 20B may be substantially U-shaped as viewed from above. In other words, the rail supporting members 20A, 20B may have parts which extend in the left-right direction, rather than being composed solely of parts which are aligned with the front-rear direction.

In the embodiment described above, a configuration may be adopted in which the front end parts of the rail supporting members 20A, 20B extend downward toward the front, and are connected to the guide rail 19.

In the embodiment described above, the frame 18 may be formed in a flat plate shape in which only the flat surface part 18*a* is formed.

In the embodiment described above, the inkjet printer 11 is described as a specific example of the liquid ejection device, but a liquid ejection device may also be employed which ejects or discharges a liquid other than ink. The present invention may be applied to various types of liquid ejection devices provided with a liquid ejection head or the like for discharging minute droplets. The term "droplet" refers to the state of the liquid discharged from the liquid ejection device, and includes droplets which leave granular, teardrop-shaped, or filament-shaped traces. The liquid referred to herein may be any liquid composed of a material which can be ejected by the liquid ejection device. For example, the liquid is preferably in a state in which the material thereof is in the liquid phase, and includes not only fluids and materials that are liquid in one state thereof, such as high or low-viscosity liquids, sol/gel solutions, and other inorganic solvents, organic solvents, solutions, liquid resins, and liquid metals (metal liquids), but liquids in which particles of functional material composed of pigments, metal particles, and other solids are dissolved, dispersed, or mixed in a solvent. Ink, liquid crystal, or the like such as described in the embodiment above are cited as typical examples of the liquid. The term "ink" includes common water-based ink, oil-based ink, gel ink, hot-melt ink, and various other liquid compositions. Specific examples of the liquid ejection device may include liquid ejection devices for ejecting liquid which includes electrode material, color material, or other material in dispersed or dissolved form for use in such applications as manufacturing liquid crystal displays, EL (electroluminescent) displays, surface-emitting displays, and color filters; liquid ejection devices for ejecting biological organic materials used to manufacture biochips; liquid ejection devices used as precision pipettes for ejecting liquids as test samples; and printing devices, microdispensers, and the like. Liquid ejection devices for ejecting lubricating oil with pinpoint precision onto a clock, camera, or other precision machine; liquid ejection devices for ejecting UV-curing resin or other transparent resin liquids onto a substrate to form micro hemispherical lenses (optical lenses) used in an optical communication device or the like; and liquid ejection devices for ejecting acid or alkaline etching solution for etching a substrate or the like may be used. The present invention may be applied to any of these types of liquid ejection devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a device body;

a frame accommodated in the device body, the frame being formed as a square frame body having a surface part in a longitudinal direction of the frame which has a flat surface, a facing surface part which has a flat surface facing the surface part, and a lateral surface part for covering between the surface part and the facing surface part at a lateral side of the frame;

a guide shaft facing the surface part of the frame in the longitudinal direction across a gap, the guide shaft having a rod shape;

a first guide shaft supporting member and a second guide shaft supporting member supporting the guide shaft, the first guide shaft supporting member and the second guide shaft supporting member being fixed to the frame;

a carriage configured to move in reciprocal manner along the guide shaft with a lubricant disposed therebetween and applied to the guide shaft;

a liquid ejection head configured to eject liquid toward a recording medium, the liquid ejection head being mounted to the carriage; and a conveyance mechanism configured to convey the recording medium below the guide shaft and the guide shaft supporting members, end parts of the first guide shaft supporting member and the second guide shaft supporting member on the side of the guide shaft thereof being directly connected to the guide shaft in a horizontal direction or downward from the horizontal direction orthogonal to an up-down direction with respect to the guide shaft so that the carriage is movable along the guide shaft over positions where the first guide shaft supporting member and the second guide shaft supporting member are connected to the guide shaft, the first guide shaft supporting member being provided between one end part of the guide shaft in a movement direction of the carriage and one end part of a region in which the liquid ejection head ejects the liquid onto the recording medium, and the second guide shaft supporting member being provided between the other end part of the guide shaft in the movement direction of the carriage and the other end part of the region in which the liquid ejection head ejects the liquid to the recording medium.

2. The liquid ejection device according to claim 1, wherein the first guide shaft supporting member and the second guide shaft supporting member are fixed to the flat surface of the surface part of the frame and connected at sites opposite the flat surface of the surface part in the guide shaft so as to protrude in the horizontal direction from the flat surface part.

3. The liquid ejection device according claim 1, further comprising an auxiliary guide shaft provided higher than the guide shaft of the frame and configured to guide the movement of the carriage and restricting rotation of the carriage, the auxiliary guide shaft being fixed to the frame via a plurality of auxiliary guide shaft supporting members with the auxiliary guide shaft supporting members being disposed higher than the auxiliary guide shaft.

4. The liquid ejection device according to claim 3, wherein the auxiliary guide shaft supporting members are fixed to the frame by screw members, through-holes for inserting the screw members in the up-down direction are provided to the auxiliary guide shaft supporting members, and the through-holes are formed in the shape of elongated holes which are elongated in the direction orthogonal to each of the up-down direction and the movement direction of the carriage.

5. The liquid ejection device according to claim 1, wherein the frame is attached to the device body in which the conveyance mechanism is accommodated.

* * * * *